US006817287B2

(12) United States Patent
Shadrach, III

(10) Patent No.: US 6,817,287 B2
(45) Date of Patent: Nov. 16, 2004

(54) SYSTEM FOR APPLYING PRINTED INFORMATION TO A PACKAGE

(76) Inventor: William S. Shadrach, III, 2239 Emerson Ave., Salt Lake City, UT (US) 84108

( * ) Notice: Subject to any disclaimer, the term of this patent is extended or adjusted under 35 U.S.C. 154(b) by 0 days.

(21) Appl. No.: 10/447,689

(22) Filed: May 29, 2003

(65) Prior Publication Data

US 2004/0011227 A1 Jan. 22, 2004

Related U.S. Application Data

(60) Provisional application No. 60/402,496, filed on Aug. 8, 2002, and provisional application No. 60/385,014, filed on May 31, 2002.

(51) Int. Cl.[7] ..... B41F 17/00
(52) U.S. Cl. ..... 101/35; 101/38.1
(58) Field of Search ..... 101/35, 38.1, 39, 101/40, 40.1, 43, 44

(56) References Cited

U.S. PATENT DOCUMENTS 3,606,162 A * 9/1971 Lehmann ..... 239/227
3,867,882 A * 2/1975 Ahlgren et al. ..... 101/35
4,455,935 A * 6/1984 Manz et al. ..... 101/35
4,745,857 A * 5/1988 Putnam et al. ..... 101/44
5,156,088 A * 10/1992 Tohdo ..... 101/35
5,315,927 A * 5/1994 Yeh ..... 101/35

* cited by examiner

*Primary Examiner*—Ren Yan
(74) *Attorney, Agent, or Firm*—Thorpe North & Western, LLP

(57) ABSTRACT

A system for applying print information to a plurality of sides of a package includes a printing station including a printing platform to receive and support the package to facilitate application of the print information to the package. At least one print applicator is associated with the printing station, and is movable with respect to the package on the printing platform. The print applicator is configured to selectively apply print information to a plurality of sides of the package. A print application actuator is configured to move the print applicator and the package relative to each other to enable the print applicator to apply information to the plurality of sides of the package.

30 Claims, 5 Drawing Sheets

SYSTEM FOR APPLYING PRINTED INFORMATION TO A PACKAGE

This application claims priority to U.S. Provisional Patent Application No. 60/385,014, filed May 31, 2002, and U.S. Provisional Patent Application No. 60/402,496, filed Aug. 8, 2002, which are both incorporated herein by reference for the relevant teachings consistent herewith.

BACKGROUND OF THE INVENTION

1. Field of the Invention

The present invention relates generally to printing systems. More specifically, the present invention relates to a system for applying printed information to packaging.

2. Related Art

In many manufacturing and packaging processes it is often desirable to apply printed information to a package after the package has been assembled; that is, after the package has been erected into the structure in which the package will be used to store items. In many conventional package configurations, a package begins as a flat sheet of material, such as cardboard, that is folded and bonded or stapled into the desired final form the package is designed to assume. Applying information to a package before it is assembled is generally easier, as the packages are often flat sections of material that can be printed utilizing methods known for printing on flat materials, i.e., small and large flat sheets of paper or cardboard. As is well known, printing technology has been developed and refined over decades for printing on flat object. Costs are lower and packages for containing and shipping products are most often printed when in an original flat configuration and later folded and/or assembled into a "box" or other package shape.

Applying printed information is also often done for the purpose of relating particular information to a particular product after packaging that particular product in a package. Such information can include brand designation, lot number, serial number, manufacture date, use-by date, UPC codes, other bar codes, shipping destination or the like. In many cases, the printed information to be applied to a package is required by distributors and/or purchasers of the product contained in the package; and so package printing of such information may be compulsory for the manufacturer or packager of the product/package.

Because much of these kinds of printed information to be applied to a package is not known until after product has been placed in the package, it is often not convenient to pre-print the information on the package when the package is in an unassembled, flat configuration. For instance, in some cases the printed information to be applied may be date-or time-specific, and so cannot be pre-printed with accuracy. For instance, shipping dates, "just-in-time" information, or real-time data may not be known when the package component(s) are manufactured and so must be applied to the package after it has been assembled and packed with product.

Some manufacturers have addressed the problem of printing on assembled packages by acquiring a large number of hand-held stamps that can be inked and stamped on the packages by hand. This solution has proven advantageous in that the information stamped is often very clearly stamped and legible. Also, provided that enough stamps are available, any type of information can be applied to the packages. However, this solution has also proven disadvantageous in that operators must maintain, and choose from, a large number of stamps. Providing a greater choice of stamps to be used can lead to an increase in the likelihood of error. Also, this process is time-consuming and requires more-costly human labor.

More recent attempts to solve these problems associated with printing information on assembled packages have led to the use of automated printing methods. In most cases, this process must be performed very quickly to maintain efficiency of the packaging process. Because of this, packages often have information printed on them as they are propelled by conveyor means past printing applicators disposed on, in or near a printing station. State of the art printing processes typically apply information to one or two sides of a package as it passes by one or two printing applicators associated with a printing station. In a case where it is desired to apply information to more than one or two sides of a package, the package usually must either be turned and passed by a second printing station, or be re-routed past the first printing station with alternate sides of the package exposed to the print applicator(s).

Current methods of printing on multiple sides of assembled packages can be expensive, as multiple printing stations may need to be provided. Furthermore, such methods may require that additional conveying means be provided, also resulting in higher costs.

SUMMARY OF THE INVENTION

It has been recognized that it would be advantageous to develop a system for applying printed information to a plurality of sides of a package with a single, integral printing station.

The invention provides a system for applying print information to a plurality of sides of a package, and includes a printing station including a printing platform to receive and support the package to facilitate application of the print information to the package. At least one print applicator can be associated with the printing station, and can be movable with respect to the package on the printing platform, and can be configured to selectively apply print information to a plurality of sides of the package. A print application actuator can be configured to move the print applicator and the package relative to each other to enable the print applicator to apply information to the plurality of sides of the package.

In accordance with another more detailed aspect of the invention, the print application actuator can move the print applicator relative to the package.

In accordance with another more detailed aspect of the invention, the print application actuator can move the package relative to the print applicator.

In accordance with another more detailed aspect of the invention, the print application actuator can comprise a rotational actuator.

In accordance with another more detailed aspect of the invention, a conveyor can be disposed adjacent the printing station and can be configured to convey the package to the printing station.

In accordance with another more detailed aspect of the invention, a second conveyor can be disposed adjacent the printing station and can be configured to convey the package from the printing station.

In accordance with another more detailed aspect of the invention, the print information applied to the package can include human-readable print information.

In accordance with another more detailed aspect of the invention, the print information applied to the package can include only human-readable print information.

In accordance with another more detailed aspect of the invention, a second print applicator can be associated with the printing station and can be configured to apply print information to at least one side of the package.

In accordance with another more detailed aspect of the invention, the second print actuator can be redundant, and can be configured to be activated in the event of failure of the print applicator.

In accordance with another more detailed aspect of the invention, a system for applying print information to a plurality of sides of a package is provided and includes a printing station, including a movable printing platform to receive and support the package to facilitate application of the print information to the package. At least one print applicator can be associated with the printing station and can be configured to selectively apply print information to a plurality of sides of the package. Means for actuating at least one of the printing platform and the print actuator can be configured to move the package disposed on the printing platform and the print applicator relative to each other to enable the print applicator to apply print information to the plurality of sides of the package.

In accordance with another more detailed aspect of the invention, a method for applying print information to a plurality of sides of a package is provided, and includes the steps of: a) delivering the package to a printing platform associated with a printing station, the printing platform receiving and supporting the package to facilitate application of the print information to the package; b) applying print information to a first side of the package using a print applicator associated with the printing station; c) moving the print applicator and the package relative to each other; and d) applying print information to a second side of the package using the print applicator.

In accordance with a more detailed aspect of the invention, the method includes the further step of applying print information to a third and a fourth side of the package using the print applicator.

In accordance with another aspect of the invention, the first and second sides of the package are substantially non-horizontally oriented, and the method includes the further step of applying print information to all non-horizontally oriented sides of the package using the print applicator.

In accordance with another more detailed aspect of the invention, the step of moving the print applicator and the package relative to each other can comprise the further step of moving the print applicator relative to the package.

In accordance with another more detailed aspect of the invention, the step of moving the print applicator and the package relative to each other can comprise the further step of moving the package relative to the print applicator.

In accordance with another more detailed aspect of the invention, the step of delivering the package to the printing platform associated with the printing station can comprise the further step of conveying the package to the printing station with a first conveyor disposed adjacent the printing station.

In accordance with another more detailed aspect of the invention, the method includes the further step of conveying the package from the printing station with a second conveyor disposed adjacent the printing station.

In accordance with another more detailed aspect of the invention, the step of moving the print applicator and the package relative to each other includes the step of rotating the print applicator and the package relative to each other.

In accordance with another more detailed aspect of the invention, the steps of applying print information to the first and second sides of the package include the further steps of applying human-readable print information to the first and second sides of the package.

In accordance with another aspect of the invention, the steps of applying print information to the first and second sides of the package include the further steps of applying only human-readable print information to the first and second sides of the package.

In accordance with another aspect of the invention, the method includes the further step of providing a second, redundant print applicator, associated with the printing station and configured to apply print information to at least one side of the package in the event of failure of the print applicator.

Additional features and advantages of the invention will be apparent from the detailed description which follows, taken in conjunction with the accompanying drawings, which together illustrate, by way of example, such features and advantages of the invention.

DETAILED DESCRIPTION

Figure 1A:
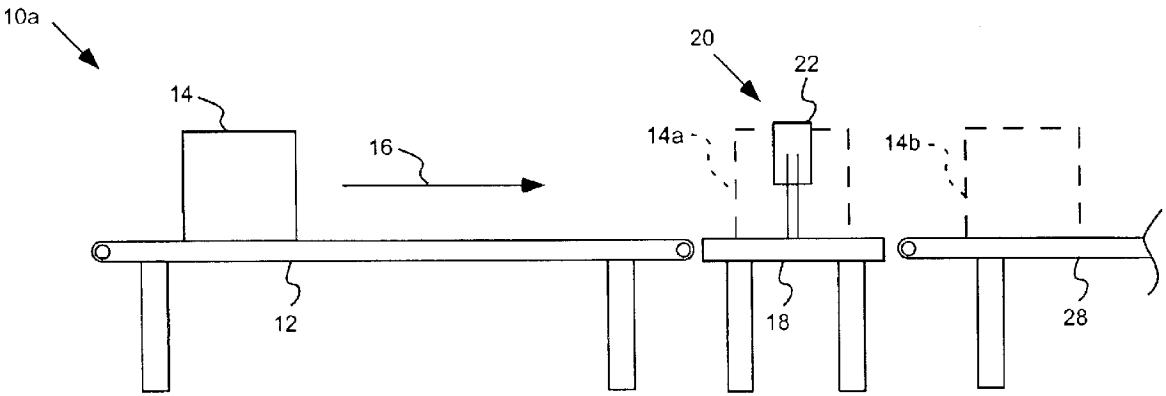
FIG. 1*a* is a side view of a system for applying information to a package in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1*a*, a system, indicated generally at 10*a*, in accordance with the present invention is shown for a system and method of applying print information to a package. Manufacturing and packaging are two examples of fields that may benefit from use of the system 10*a* for applying printed information to a package. For example, the present invention can be used to apply printed information to packages already containing products when it is not practical or possible to apply the information prior to assembling and packaging the product. Such information might include, for example, alphanumeric descriptions of the product, shipping destination information, numerical information, and/or machine-readable bar codes. The printed information can be applied to a package after the package has been assembled or erected into its final form and size.

In accordance with one aspect of the present invention, the system 10*a* provides a first conveyor 12 configured to receive and transport a package 14. The conveyor 12 can be of a variety of types known to those skilled in the art, such as a conveyor belt, a series of rolling bars, etc. The package 14 conveyed by the conveyor 12 can similarly be of a variety of sizes and shapes. While the package illustrated in the figures is generally square, the present invention can be utilized with packages that are rectangular, cylindrical, or otherwise shaped. In addition, printed information can be applied to packages having three, four, five, six, or more sides in addition to a top or a bottom of the package. As used herein, the term "package" is understood to mean a container or other storage device that is assembled or erected into the final shape and form it was designed to exhibit. "Package" can include, for example, assembled wooden or cardboard boxes that have been erected into a box or other form in which the package was intended to assume to receive products or materials to be stored within the package. As used herein, "package" does not include flat or planar materials which may later be assembled into a package structure.

Figure 1B:
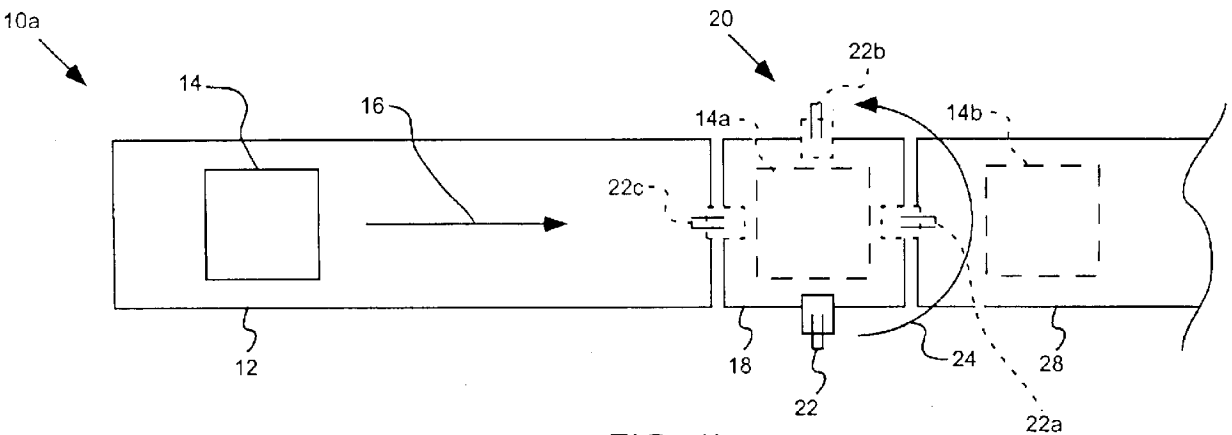
FIG. 1*b* is a top view of one aspect of the system illustrated in FIG. 1*a;*

The package can travel along the first conveyor 12 in direction of arrow 16, where it is received by printing platform 18. In the embodiment of FIGS. 1*a* and 1*b*, platform 18 is stationary, and can itself include some type of conveying means to propel the package onto, off of, or along the platform. The printing platform 18 can also include motion retardation means (not shown) for stopping or slowing movement of the package.

Once the package, as illustrated at 14*a*, arrives at the printing platform 18, printing station 20, of which printing platform 18 is associated, can apply printed information (not shown) to the package. The printed information applied to the package can include bar codes, part numbers, open-date-coding, branding, production information, etc. In addition, in one aspect of the invention, the printed information includes human-readable information. As used herein, the term "human-readable" information is understood to mean information that can be read or observed and understood by a cognizant human. "Human-readable" information can include, without limitation, textual information, alphanumeric information, iconographical information, seasonal information, information related to usage of a product, or any combination thereof. For example, iconographical information can include seasonal icons, such as Christmas trees or Valentines day hearts, etc., that can be associated with products contained or to be contained in the package. Usage information can be text warning of restricted uses such as "Not for Human Consumption," or can include recognizable icons indicating similar information, such as an icon of a human placing an item in his or her mouth with the well known prohibitory symbol of a circle with a bar crossed through it superimposed over the icon. "Human-readable" information does not include, for example, bar-code information, data stored on a magnetic strip, or any information that must be read and converted by a machine into a form understandable by a cognizant human.

Printing station 20 can include print applicator 22 for the purpose of applying the printed information to the package. Print applicator 22 can be of a variety of types known to those skilled in the art, including a print head, a stamping assembly, a laser print head, a labeling head or an ink jet print head. Of course, other known printed information applicators or application devices can similarly be used. In the case where the print applicator includes a labeling head, the applicator can first apply printed information to a label, then transfer or apply the label to the package. For example, the labeling head print applicator can be supplied with pre-printed labels that include general branding information related to a particular company, and the labeling head print applicator can apply specific printed information to the label prior to adhering the label to the package.

It will be appreciated that printing station 20 can be located at any location along any of the conveyers and can be made mobile so as to enable an operator to move the printing station from one location to another. Thus, the present invention can be used on multiple production or shipping lines at various times, eliminating the need to purchase an independent printing station for each line. The present invention will thus be advantageous for business which have multiple conveyor lines that may not all be in use at the same time.

Multiple, redundant print applicators (not shown) can be included to provide additional reliability in the case one print applicator fails to operate, reducing "down time" otherwise necessary to repair or replace a faulty print applicator. The redundant print applicators can be located and oriented in any manner with respect to the primary print applicator. For instance, the redundant and primary print applicators can be located on opposing ends of a rotatable support structure. In the case that the primary print applicator fails, the rotatable support structure can rotate the primary print applicator out of position and rotate the redundant print applicator into position. Alternately, the redundant print applicator can be located adjacent the primary print applicator and control circuitry can shut down the primary print applicator and initiate the redundant print applicator without requiring the repositioning of any print applicators. The redundant print applicator can be actuated and moved into position in a variety of manners, as would occur to those skilled in the art.

In the embodiment shown in FIGS. 1*a* and 1*b*, print applicator 22 can be movable relative to the package 14*a*. In one aspect of the invention, the print applicator can be rotatable about the package 14*a*. As shown in FIG. 1*b*, print applicator 22 can apply information to the first side of the package as referenced by print applicator 22 in FIG. 1*b*. After the information has been applied, print applicator 22 can rotate about the package 14*a* to apply information to alternate sides of the package, as shown at 22*a*, 22*b*, and 22*c*.

The print applicator can rotate in a variety of directions, including either clockwise or counterclockwise, and, in one aspect, can rotate horizontally about a vertical axis, as shown by arrow 24 in FIG. 1*b*. While the discussion herein addresses printing to multiple sides of a package, it is to be understood that the term "sides" indicates outer surfaces of the package. The term "sides" is not limited to what may be considered the sides of a package in contrast to the top or bottom of a package. Thus, a package may be delivered to the printing station with the top and bottom of the package exposed to the print applicator, and have printed information applied to the top and bottom "sides" of the package. In addition, in one embodiment of the invention, printed information is applied to all substantially non-horizontal sides of the package. As used herein, the term "substantially non-horizontal" is understood to refer to sides of a package that vary from true horizontal (i.e., perpendicular from the gravity vector) by more than about 5 degrees. Thus, in the case where the package includes four sides arranged in a pyramidal shape, each side but the base side, as known in the art, is substantially non-horizontal.

Print applicator 22 can be incorporated into printing station 20 in any manner known to those skilled in the art.

It will be understood that the print applicator will require actuation and feedback means to ensure proper operation. Such actuation means may include hydraulic or gear driven lifting arms or electrically operated supporting structure, and other actuators, as is well known in the art. Similarly, the print applicators can include feedback and sensor systems to allow the print applicators to be controlled remotely by a computing system (as discussed in more detail below).

It will be appreciated that the present invention can rapidly apply printed information to a plurality of sides of a package without requiring that the package be routed to additional printing stations. The present invention can be used by manufacturers or packagers to apply information to multiple sides of packages of a variety of configurations. The packages can include primary packages, which hold a product ready to be shipped or delivered, and also secondary packages, which hold a number of already packaged products bundled together into a larger package. Because the present invention can be driven or controlled by a computer, as discussed in further detail below, the printed information to be applied to the packages can be rapidly changed, as an operator or the computer need only send to the printing station 20 a different definition of the printed information to be applied to the package. In this manner, packages from a variety of distribution or production lines can be routed past the print station and marked appropriately, even if the printed information to be applied must be changed with each package arriving at the print station.

Figure 2:
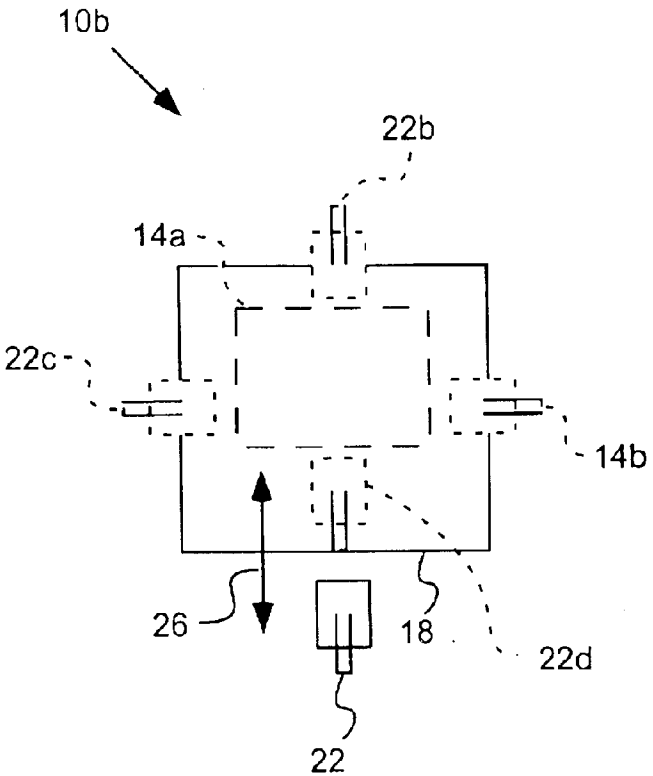
FIG. 2 is a top view of an another aspect of the embodiment illustrated in FIG. 1*b;*

As illustrated at 10*b* in FIG. 2, which shows a top view of the package 14*a*, the print applicator 22 can not only be rotatable with respect to the package 14*a*, but can be linearly movable with respect to a face or side of the package. As shown by arrow 26, print applicator 22*d* can move toward or away from the package depending on the particular print applicator and print job. The print applicator may also include a sensor (not shown) that detects and processes the distance between the package and the print applicator. The print applicator can thus be utilized with packages of different sizes and still be moved close enough to the package to allow accurate and legible application of printed information to the package. Once all desired information is applied to the package, the package can be moved onto second conveyor 28 for further processing or shipping, as shown by package 14*b* in FIGS. 1*a* and 1*b*.

Figure 3A:
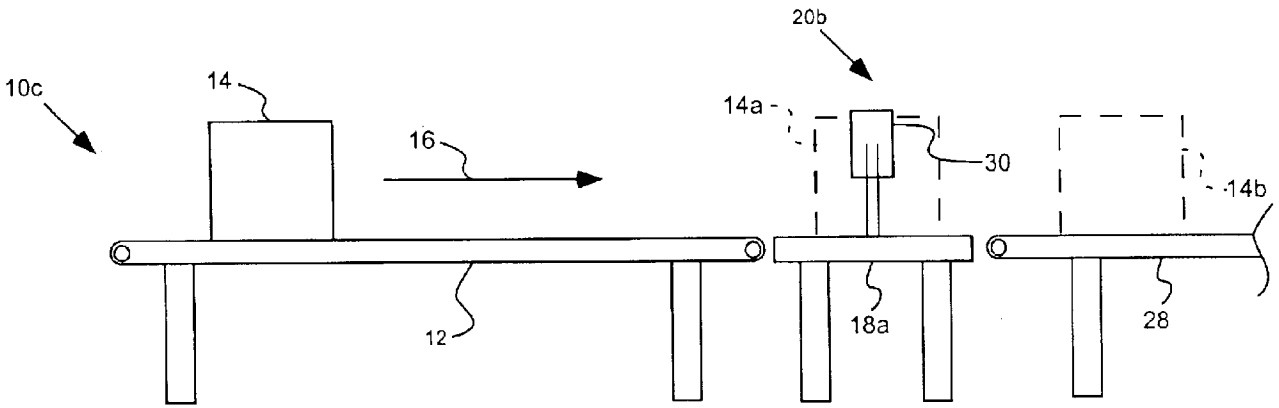
FIG. 3*a* is a side view of another aspect of the system of the present invention.
Figure 3B:
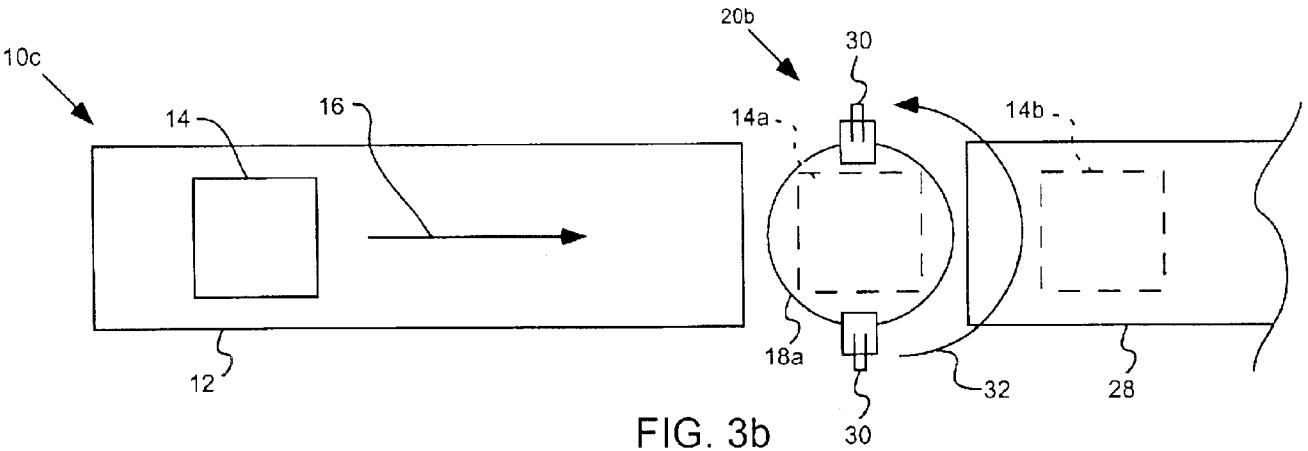
FIG. 3*b* is a top view of the embodiment illustrated in FIG. 3*a;*

Another aspect of the present invention is illustrated at 10*c* in FIGS. 3*a* and 3*b*. Many of the features and advantages of the previous embodiment are present in this embodiment, including first conveyor 12, package 14, and second conveyor 28. As in previous embodiments, the package 14 is conveyed by conveyor 12 to a printing station 20*b*. A platform 18*a*, associated with printing station 20*b*, can receive the package for printing. In this embodiment, the platform 18*a* can be configured to rotate or translate the package with respect to printing applicator 30.

As illustrated in FIG. 3*b*, the package 14*a*, once received by the platform 18*a*, can be rotated with respect to print applicators 30 as shown by arrow 32. Of course, one or more print applicators can be utilized as well as the pair shown in FIG. 3*b*. In this manner, information can be applied to one or more sides of the package, the package can be quickly moved or rotated, and information can be applied to alternate sides of the package. The platform can also include conveying or stopping means for moving or holding the package before and after printing.

As in previous embodiments, the print applicators 30 can be movable linearly with respect to the package to facilitate closely aligning the print applicators with the package as necessary for the particular print applicator used. The print applicators can be movable left or right and up or down, relative to the package. Also, as in the previous embodiment, the print applicators can include sensors (not shown) which detect the location of the package to facilitate moving the print applicators proximate the package. The print applicators can thus sense the location of the package and move closer or further from the package, as desired. The print applicators and the package can also be located in known, fixed positions to facilitate application of information to the package, without requiring sensing of the package location.

Figure 4:
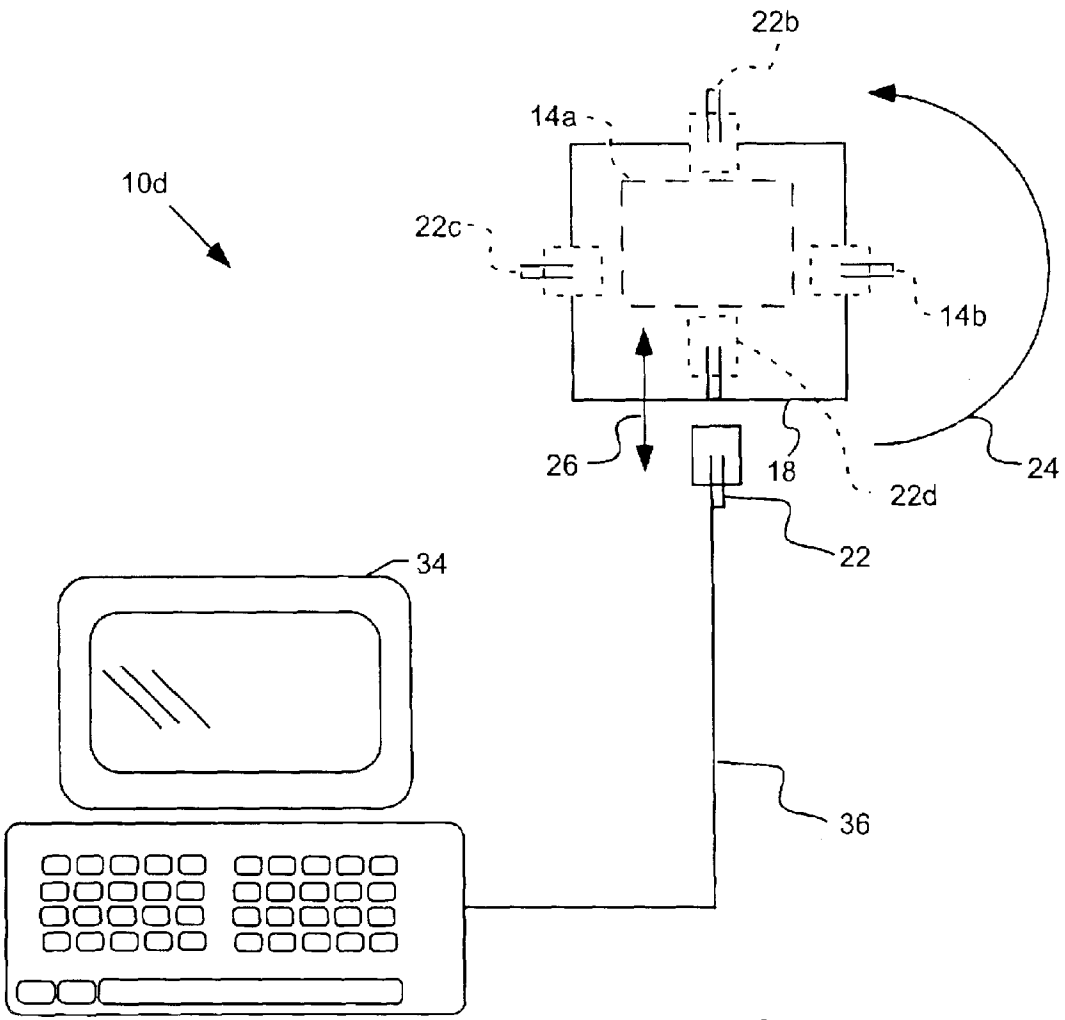
FIG. 4 is a top view of another aspect of the embodiment illustrated in FIG. 2.

An alternate embodiment of the embodiment illustrated in FIG. 2 is shown at 10*d* in FIG. 4. For simplification purposes, only the package 14*a*, the platform 18, and the print applicator 22 are shown. Here, a computer 34 can control the print applicator 22 via communication line 36. The present invention thus allows an operator to control the printing process through the computer 34. The type, size, and content of information applied to the package can all be controlled by simple keystrokes from the operator. In addition to the local control shown in FIG. 4, the print applicator and station can be linked through a Local Area Network or similar control system to be controlled from a central location. Thus, multiple printing stations can be established at various locations and can be controlled through a central controller. This central controller can be located geographically distant from the production or packaging location, such as at a central command office.

Figure 5:
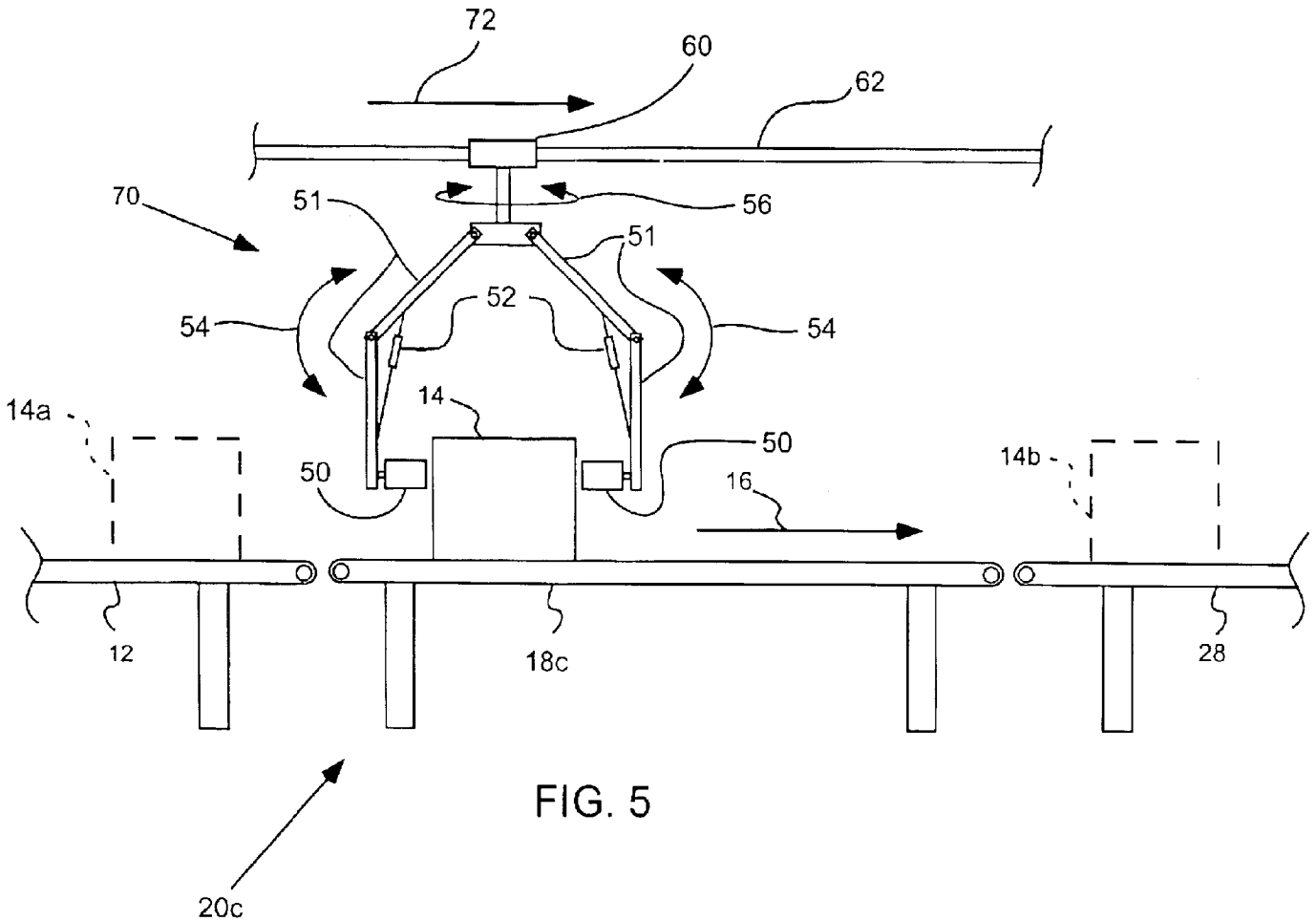
FIG. 5 is a side view of another aspect of the present invention.

As shown in FIG. 5, a printing station 20*c* in accordance with the present invention can include conveyable receiving platform 18*c* that can receive the package for printing and can convey, or continue moving, the package during the printing process. As in previous embodiments, package 14 can be conveyed or delivered to receiving platform 18*c* by first conveyor 12, and conveyed from the receiving platform by second conveyor 28, as indicated by packages 14*a* and 14*b*, respectively. As the receiving platform itself includes conveying means, the package can travel to, over, and from platform 18 without significant change to the speed at which the package is propelled through the packaging or manufacturing process. In this embodiment, a print head assembly 70 can include print heads 50, actuatable arms 51, and actuators 52, each of which are known to those skilled in the art. The print head assembly can facilitate movement of the print heads relative to the package, in both translational and rotational aspects.

Print heads 50 can be rotated, moved and/or translated upwardly, laterally and downwardly, as shown by arrows 54, by actuation of arms 51 via actuators 52. As shown by arrows 56, the print head assembly is rotatable with respect to the package. Thus, arms 51 can move print heads 50 into printable vicinity of package 14 to facilitate application of printed information to one or more sides of the package. After printing on one or more sides of the package, arms 51 can move upwardly and/or laterally away from the package, and the print head assembly can rotate or be rotated about the package. Arms 51 can then be moved and/or lowered into printable vicinity of alternate sides of the package to facilitate application of print information to the alternate sides. This process can be repeated as many times as desired to apply information to as many sides of the package as desired.

As shown at arrow 72, print head assembly 70 can advantageously be moveable with respect to receiving platform 18*c*. In the embodiment shown in FIG. 5, the print head assembly is moveably coupled at 60 to support structure 62, by means known to those in the art. Thus, as the package is moved proximal to the print head assembly, and is conveyed by receiving platform 18*c*, the print head assembly can move laterally with the package to apply printed information to multiple sides of the package while the package is moving. The system can thus apply information to multiple sides of the package without slowing or otherwise delaying the progress of package 14 through the manufacturing or packaging process.

From the foregoing discussion, it will be clear to one skilled in the art that the present invention can be incorporated into existing packaging or shipping systems. A shipper or manufacturer can utilize the present invention to apply information to packages which are varied in size and content, even if the packages are processed on different conveyor lines. For instance, a shipper or manufacturer may have three different conveyor lines for three different products. The three different conveyor lines can be made to converge onto a common conveyor near which the present invention is located. A sensing system (not shown) can automatically detect which of the three types of product is approaching the printing station and automatically alter which information is applied to which type of product.

It will be understood that the disclosure and examples provided herein are to illustrate the inventive principles of the present invention and that specific elements which may be required to support the underlying invention have not been addressed in detail. For example, the printing station 20 may require additional structure, such as motorized control, sensing and feedback systems, or other such devices to operate properly, as is known in the art. The conveyors may similarly include additional structure such as sensing systems and safety mechanisms which are not described in detail herein. Also, the receiving platform 18 may require actuator means to rotate, translate, or otherwise manipulate the package, as would occur to one skilled in the art.

As discussed above, the present invention can apply a variety of printed information to a variety of packages. In one embodiment, the printed information includes human-readable information. This aspect of the invention can be advantageously utilized as the type of information applied to packages in general changes with advances made in identification and tracking of packages. For example, with the increased use of systems such as Radio Frequency Identification ("RFID") systems, the amount of machine-readable information applied to packaging is believed to be decreasing. RFID systems can sense and track the location of packages across a wide geographical area without the need to perform optical scanning of the packages, as each package generates and emits a unique radio-frequency signal that can be identified by tracking systems.

As the amount of machine-readable information on packages decreases, the need for printing such information on multiple sides of assembled packages also decreases. However, including human-readable printed information on multiple sides of packages to enable visual identification of a package's contents, destination, use-by-date, etc., remains an important consideration. The present invention can advantageously apply human-readable printed information to a package to provide a recognizable and understandable medium for humans to obtain information about the package, regardless of which type of tracking device or information is used in tracking the package.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A system for applying print information to a plurality of sides of a package, comprising:

a) a printing station including a printing platform, the printing platform being configured to receive and support the package to facilitate application of the print information to the package;

b) at least one print applicator, rotatable about an axis intersecting the printing platform, the at least one print applicator being movable with respect to the package on the printing platform, and being configured to selectively apply print information to a plurality of sides of the package; and c) a print application actuator, said actuator being configured to move the print applicator about the package to enable the print applicator to apply information to the plurality of sides of the package.

2. The system of claim 1, wherein the print application actuator comprises a rotational actuator.

3. The system of claim 1, further comprising a conveyor, disposed adjacent the printing station and being configured to convey the package to the printing station.

4. The system of claim 3, further comprising a second conveyor, disposed adjacent the printing station and being configured to convey the package from the printing station.

5. The system of claim 1, wherein the print information applied to the package includes human-readable print information.

6. The system of claim 5, wherein the print information applied to the package includes only human-readable print information.

7. The system of claim 1, further comprising a second print applicator, associated with the printing station and being configured to apply print information to at least one side of the package.

8. The system of claim 7, wherein the second print applicator is redundant, and is configured to be activated in the event of failure of the print applicator.

9. The system of claim 1, wherein the print applicator is rotatable about at least four sides of the package.

10. A system for applying print information to a plurality of sides of a package, comprising:

a) a printing station, including a movable printing platform having support surface, the printing platform being configured to receive and support the package to facilitate application of the print information to the package;

b) at least one print applicator, associated with the printing station and being configured to selectively apply print information to a plurality of sides of the package; and c) means for rotatably actuating the support surface of the printing platform relative to the print applicator, said means for actuating being configured to rotate the support surface with the package disposed on the printing platform relative to the print applicator to enable the print applicator to apply print information to the plurality of sides of the package.

11. The system of claim 10, further comprising a conveyor, disposed adjacent the printing station and being configured to convey the package to the printing station.

12. The system of claim 11, further comprising a second conveyor, disposed adjacent the printing station and being configured to convey the package from the printing station.

13. The system of claim 10, wherein the actuating means comprises a rotational actuating system.

14. The system of claim 10, wherein the print information applied to the package includes human-readable print information.

15. The system of claim 14, wherein the print information applied to the package includes only human-readable print information.

16. The system of claim 10, further comprising a second print applicator, associated with the printing station, and being configured to apply print information to at least one side of the package.

17. The system of claim 16, wherein the second print applicator is redundant, and is configured to be activated in the event of failure of the print applicator.

18. The system of claim 10, wherein the support surface and the package are rotatable about parallel axes.

19. A method for applying print information to a plurality of sides of a package, comprising the steps of:

a) delivering the package to a printing platform associated with a printing station, the printing platform receiving and supporting the package to facilitate application of the print information to the package;

b) applying print information to a first side of the package using a print applicator associated with the printing station;

c) rotating the print applicator about the package and an axis intersecting the printing platform to a position adjacent a second side of the package; and d) applying print information to the second side of the package using the print applicator.

20. The method of claim 19, comprising the further step of applying print information to a third and a fourth side of the package using the print applicator.

21. The method of claim 19, wherein the first and second sides of the package are substantially non-horizontally oriented, and comprising the further step of applying print information to all non-horizontally oriented sides of the package using the print applicator.

22. The method of claim 19, wherein the step of delivering the package to the printing platform associated with the printing station comprises the further step of conveying the package to the printing station with a first conveyor disposed adjacent the printing station.

23. The method of claim 22, comprising the further step of conveying the package from the printing station with a second conveyor disposed adjacent the printing station.

24. The method of claim 19, wherein the steps of applying print information to the first and second sides of the package include the further steps of applying human-readable print information to the first and second sides of the package.

25. The method of claim 24, wherein the steps of applying print information to the first and second sides of the package include the further steps of applying only human-readable print information to the first and second sides of the package.

26. The method of claim 19, comprising the further step of providing a second, redundant print applicator, associated with the printing station and configured to apply print information to at least one side of the package in the event of failure of the print applicator.

27. The method of claim 19, wherein the print applicator is rotatable about at least four sides of the package.

28. A method for applying print information to a plurality of sides of a package, comprising the steps of:

a) delivering the package to a printing platform associated with a printing station and having a support surface, the support surface receiving and supporting the package to facilitate application of the print information to the package;

b) applying print information to a first side of the package using a print applicator associated with the printing station;

c) rotating the support surface of the printing platform together with the package relative to the print applicator to expose a second side of the package to the print applicator; and d) applying print information to the second side of the package using the print applicator.

29. The method of claim 28 wherein the step of rotating the support surface together with the package includes the step of rotating the support surface and the package about parallel axes.

30. A system for applying print information to a plurality of sides of a package, comprising:

a) a printing station including a printing platform, the printing platform being configured to receive and support the package to facilitate application of the print information to the package;

b) at least one print applicator, associated with the printing station and being configured to selectively apply print information to a plurality of sides of the package; and c) a print application actuator, said actuator being configured to move the print applicator and the printing platform relative to each other about an axis intersecting the printing platform to enable the print applicator to apply information to the plurality of sides of the package.

* * * * *